US008185988B2

(12) United States Patent
Wieland

(10) Patent No.: US 8,185,988 B2
(45) Date of Patent: May 29, 2012

(54) GRID SPRING MATTRESS

(75) Inventor: Rainer Wieland, Venice, CA (US)

(73) Assignee: Somnium, Inc., Venice, CA (US)

( * ) Notice: Subject to any disclaimer, the term of this patent is extended or adjusted under 35 U.S.C. 154(b) by 933 days.

(21) Appl. No.: 12/101,825

(22) Filed: Apr. 11, 2008

(65) Prior Publication Data

US 2008/0189867 A1 Aug. 14, 2008

(51) Int. Cl.
*A47C 23/02* (2006.01)

(52) U.S. Cl. ..... 5/719; 5/247

(58) Field of Classification Search ..... 5/247, 255, 5/719, 737, 738

See application file for complete search history.

(56) References Cited

U.S. PATENT DOCUMENTS

| | | | | |
|---|---|---|---|---|
| 5,395,097 | A | 3/1995 | Dabney et al. | |
| 5,401,007 | A | 3/1995 | Dabney et al. | |
| 5,768,726 | A * | 6/1998 | Myles | 5/737 |
| 5,787,533 | A | 8/1998 | Fromme | |
| 6,113,082 | A | 9/2000 | Fujino | |
| 6,182,315 | B1 | 2/2001 | Lee | |
| 6,427,990 | B1 * | 8/2002 | Hartmann | 267/158 |
| 6,477,727 | B1 | 11/2002 | Fromme | |
| 6,721,982 | B2 | 4/2004 | Freeman | |
| 6,826,791 | B2 | 12/2004 | Fromme | |

FOREIGN PATENT DOCUMENTS

| | | |
|---|---|---|
| AT | 8325 | 6/2006 |

* cited by examiner

*Primary Examiner* — Fredrick Conley
(74) *Attorney, Agent, or Firm* — Marc E. Hankin; Kevin Schraven; Hankin Patent Law, APC

(57) ABSTRACT

Various embodiments of this invention disclose a mattress with two cover layers that enclose a spring grid array core wherein the springs are mounted back to back on a single grid support. The spring array is surrounded by a frame layer and is divisible into separate recumbence areas by supportive flanges.

21 Claims, 6 Drawing Sheets

GRID SPRING MATTRESS

FIELD OF INVENTION

This invention generally relates to mattresses. Moreover, it pertains specifically to a mattress with two cover layers that enclose a spring grid array core that comprises springs mounted back to back on a grid support, and wherein the springs have support plates connected to a base section via a spring arm. This type of spring is known in the art as a Belleville spring.

BACKGROUND

For centuries, people have been sleeping on mattresses to get a more comfortable rest, in order to be elevated off of the floor, and to gain protection from the elements. Several challenges face designers of mattresses including how to provide a reasonably priced high quality mattress, how to provide sufficient ergonomic support, how to reduce the amount of the sleeper's perspiration that is absorbed and retained by the mattress, and how to make the springs of the mattress last longer and provide more comfort. Two common types of mattresses are the metal spring mattress and the foam mattress. Although both the metal spring mattress and the foam mattress provide a more comfortable rest than sleeping on the floor, neither adequately reduces the absorption and retention of moisture and perspiration by the mattress. Moisture and perspiration absorption and retention is bad, because dust mites thrive on the moisture and perspiration retained by the mattress. Excessive dust mite dander and waste causes an allergic response in many people. Additionally, metal spring mattresses fatigue from use, start to sag, and become increasingly less comfortable. Metal spring mattresses that are inexpensive do not sufficiently protect the sleeper from pressure points caused by the metal springs. Metal spring mattresses are also very heavy and very difficult to move or even flip over. Finally, metal spring mattress cause electro-magnetic fields, which can interfere with sleep. There is a need in the art for a mattress that is light, free of metal, ergonomic, comfortable, and allows proper ventilation to reduce the amount of perspiration and moisture that is absorbed and retained by the mattress.

In the field of Belleville springs, some springs have been developed that function as a support system for separate cushions. One such Belleville spring is disclosed by U.S. Pat. No. 6,826,791 to Fromme (hereinafter "Fromme 1"), which discloses a spring element for supporting a seat cushion or a mattress. The Fromme 1 spring elements connect to a rigid platform in an array that supports a separate cushion on which a user sits or sleeps. Although Fromme 1 discloses an optimal type of spring, it fails to disclose attaching these springs back to back on a flexible grid and inserting that spring grid array into the core of a double-sided mattress. In fact, Fromme 1 specifically recites that the springs, when arrayed on a rigid platform, act similar to a box spring, and not as a mattress core. This is a fundamental difference.

Another Belleville spring cushion support system is disclosed by U.S. Pat. No. 5,787,533 to Fromme (hereinafter "Fromme 2"), which discloses a cushioning support system for a mattress comprising a plurality of springs forming a grid structure. Fromme 2 specifically discloses and claims a box spring system that supports a foam chair cushion or a mattress. Although Fromme 2 discloses an optimal type of spring, it fails to disclose attaching these springs back to back on a flexible grid and inserting that spring grid array into the core of a double-sided mattress. In fact, Fromme 2 specifically recites that the springs, when arrayed on a rigid platform, act similar to a box spring, and not as a mattress core.

Another Belleville spring cushion support system is disclosed by U.S. Pat. No. 6,477,727 to Fromme (hereinafter "Fromme 3"), which discloses support structure for a cushion or a mattress comprised of intersecting support structure elements (under-crosses or grid sections) with bearing (spring) elements connected on top. See FIG. 7a and Col. 7 lines 29-31. Although Fromme 3 discloses an optimal type of spring and a grid with a Belleville spring array, it fails to disclose attaching these springs back to back on a flexible grid and inserting that spring grid array into the core of a double-sided mattress.

In the area of mattress ventilation systems and structures, several systems and structures have been developed that allow ventilation in an effort to avoid moisture absorption and retention. One such mattress ventilation system is disclosed by U.S. Pat. No. 6,182,315 to Lee, which discloses a three layer nylon and steel fiber mesh structure that is placed on top of a cushion or mattress. Although Lee's structure does promote ventilation, it fails to disclose a mattress with Belleville springs attached back to back on a grid support or that spring grid array inserted into the core of a double-sided mattress. Further, Lee's ventilation structure is more concerned with allowing perspiration to evaporate from the user's body, rather than allowing perspiration and moisture to ventilate out of the mattress itself.

In the area of internal cushion layers adjoining a spring layer in mattresses, numerous mattresses feature cushions that enclose a spring core. One such mattress is disclosed by U.S. Pat. No. 6,721,982 to Freeman, which discloses a quilted internal cushion directly adjacent to a spring array core of a mattress. Although Freeman recites a cushion layer or layers that enclose a spring core of a mattress, it fails to disclose a mattress with a core comprised of Belleville springs attached back to back on a grid support.

In the field of two spring arrays making up the core of a mattress, several mattresses feature mattresses cores with dual spring arrays. One such mattress is disclosed by U.S. Pat. No. 5,401,007 to Dabney et al. (hereinafter "Dabney 1"), which discloses a wire spring mattress core wherein two separate spring arrays that snap fit together in a front to front connection. The Dabney 1 mattress core specifically recites that each of the spring arrays attaches to a separate grid support. As such, the Dabney 1 mattress core has two separate grid supports and the springs are connected in a face to face manner. Although Dabney 1 discloses a double-sided mattress core with two spring arrays, it does not disclose a non-wire Belleville spring, or springs that are attached back to back on a single grid support. Further, Dabney 1 recites that the base of the springs are adjacent to the enclosing cushioning layers. Thus, Dabney 1 does not disclose a mattress core wherein the distal end of the springs are adjacent to the enclosing cushioning layers.

Another type of dual spring array mattress cores is disclosed by U.S. Pat. No. 5,395,097 to Dabney et al. (hereinafter "Dabney 2"), which discloses a wire spring mattress core wherein two separate spring arrays nestably fit together in a distal end to distal end connection. The Dabney 2 mattress core specifically recites that each of the spring arrays attaches to a separate grid support. As such, the Dabney 2 mattress core has two separate grid supports and the distal end of the springs contact or attach nestably to the base end of opposite grid support. Although Dabney 2 discloses a double sided mattress core with two spring arrays, it does not disclose a non-wire Belleville spring, or springs that are attached back to back on a single grid support. The reversed orientation of Dabney I or Dabney 2 is integral to those inventions and it would not be an obvious improvement merely to reverse the orientation because to do so, the entire structure of the mattress would be affected and changed thereby.

In the area of non-wire springs, numerous types have been developed that allow mattresses to be made with non-wire springs. One such non-wire spring is disclosed by U.S. Pat. No. 6,113,082 to Fujino, which discloses a non-wire spring that is shaped similar to traditional wire springs for mattresses. Fujino recites a resin or plastic spring wherein the springs are arrayed parallel between two grid supports. Although Fujino discloses a non-wire spring array inserted into the core of a double-sided mattress, it fails to disclose a Belleville spring, or springs that are attached back to back on a single grid support.

Thus, there remains a long-felt need in the art for a mattress that is light, free of metal, ergonomic, comfortable, and allows proper ventilation to reduce the amount of perspiration and moisture that is retained by the mattress.

SUMMARY OF THE INVENTION

To minimize the limitations in the prior art, and to minimize other limitations that will become apparent upon reading and understanding the present specification, the present invention discloses a mattress with two cover layers that enclose a spring array core wherein the springs are mounted back to back on a single grid support. The spring array is surrounded by a frame layer and is divisible into separate recumbence areas by supportive flanges.

One embodiment of this invention is a mattress comprising a top cover layer, a bottom cover layer, a cavity between the top cover layer and bottom cover layer, and a spring array comprising a plurality of grid supports and a plurality of springs. The plurality of springs are attached on opposite sides of the plurality of grid supports and the grid supports are connected to each other laterally. This laterally connected grid support array is inserted in between the top cover layer and bottom cover layer. The plurality of springs are plastic and comprise a support plate, a plurality of spring arms, and a base. The plurality of springs show varying spring flexibility depending on where they are located on the connected grid supports. The mattress further comprises a frame layer that encloses the spring array and a removable mattress cover. The mattress is divided into a plurality of recumbence areas and these recumbence areas exhibit varying spring flexibility. The recumbence areas are separated by flanges so they can provide independent support and flex characteristics. The recumbence areas can also be divided into a plurality of subdivisions. These subdivisions exhibit varying spring flexibility.

Another embodiment of the invention is a mattress, comprising a top cover layer, a bottom cover layer, a cavity between the top cover layer and bottom cover layer, and a spring array comprising a plurality of grid supports and a plurality of springs. The plurality of springs comprise a plurality of support plates, a plurality of spring arms, and a mid-base. The plurality of springs are attached to the plurality of grid supports at the mid-base of the plurality of springs. The plurality of grid supports are connected to each other. The connected grid supports are inserted into said cavity between said top cover layer and bottom cover layer; and the plurality of springs are made of plastic. The plurality of springs show varying spring flexibility depending on where they are located on said connected grid supports. The mattress further comprises a frame layer that encloses a plurality of sides of said spring array, and a removable mattress cover. The mattress is divided into a plurality of recumbence areas, and the plurality of recumbence areas exhibit differing spring flexibility. The plurality of recumbence areas are separated by flanges so that the plurality of recumbence areas provide independent support and flex characteristics. The plurality of recumbence areas are divided into a plurality of subdivisions. The plurality of subdivisions exhibit varying spring flexibility.

An object of the present invention is to provide a light weight, ergonomic, and comfortable mattress that will overcome the deficiencies of the prior art.

Another object of the present invention is to provide a mattress that allows proper ventilation to prevent the absorption and retention of moisture and perspiration.

Another object of the present invention is to provide a mattress that is not made with wire or metal springs that can cause: 1) painful pressure points and prevent muscles from fully relaxing; 2) electromagnetic fields; and 3) the mattress to be excessively heavy.

The present invention is a significant improvement over the usual metal spring mattress. Because the spring core of a usual metal spring mattress cannot distribute the load of a reclining person to the best advantage, the metal springs are connected to two spring supports (one top support and one bottom support) in the form of rigid or flexible latticework. Instead of two spring support latticeworks, an embodiment of the present invention simply connects two Belleville springs together at their bases with each spring mounted on opposing sides of a single grid support. Once mounted back to back, the grid support is connected to other grid supports such that the springs are held at a set distance from each other to form a spring array. The spring support plates are directed away from the spring base. With appropriate distribution of interconnected spring mounted grid supports, the support plates act as a defacto support latticework when they contact in a flush manner the cover layer to which they are adjacent. Importantly, the spring support plates, unlike traditional metal springs, need no additional bracing beyond what is provided by the other spring components and the single flexible grid support. When the spring array of the present invention is inserted into the mattress cavity, the cavity is still relatively hollow and thus allows for beneficial ventilation.

Other features and advantages are inherent in the mattress claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance "plastic" refers to any natural or synthetic polymer resin such as cellulose, polyethylene or polystyrene. "Foam" refers to any natural, or synthetic soft and supportive padding such as polyurethane foam, foam rubber, or viscoelastic memory foam. Foam can also be made from renewable resources, such as soy or castor oil.

Figure 1:
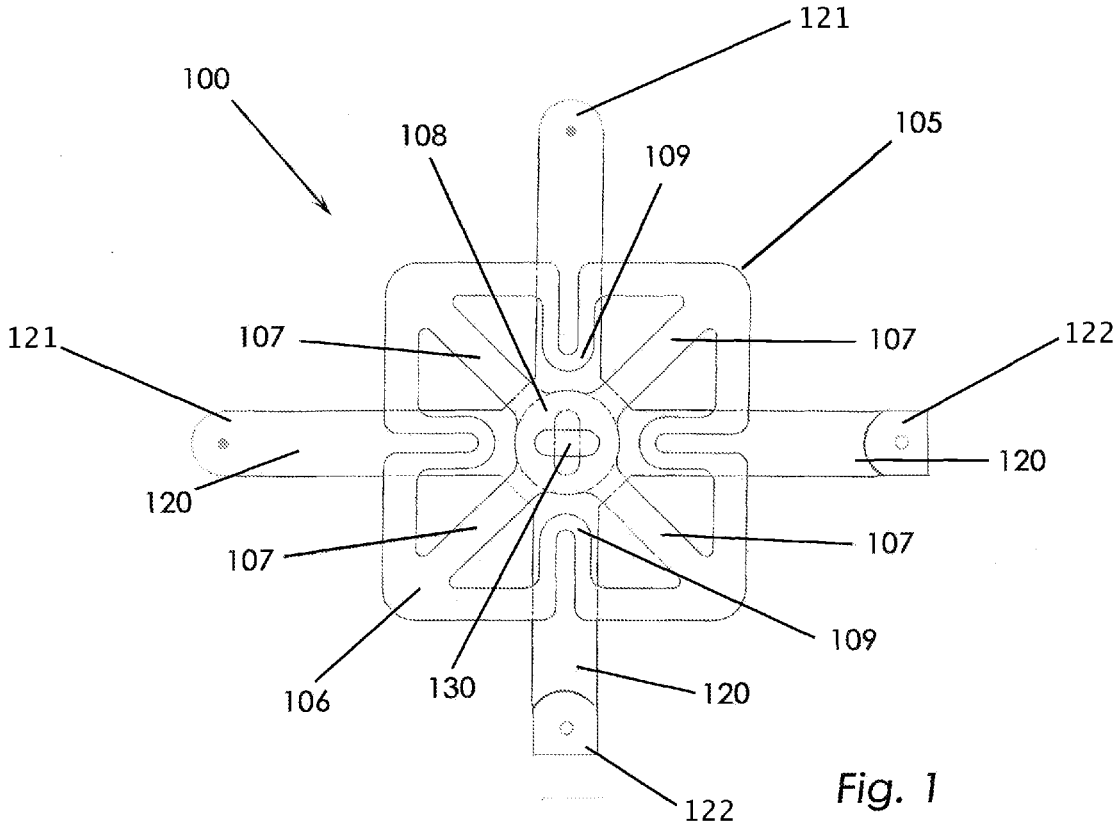
FIG. 1 is a detailed illustration of a top view of one embodiment of a spring element.

FIG. 1 is a detailed illustration of a top view of one embodiment of a spring element. FIG. 1 shows spring element 100 is comprised of spring 105 and grid support 120. Spring 105 is preferably plastic. Grid support 120 is preferably flexible and made of plastic, but can be made from any natural or synthetic material such as: metal; metal alloy; wood or other fibrous plant product such as hemp, paper, or cardboard; composite materials such as graphite, fiberglass, boron, or Kevlar; admixtures of plastic resins combined with metal, metal alloy, wood or other fibrous plant product, or composite materials; or any combination of these materials, without departing from the scope of the present invention. As shown in FIG. 1, spring 105 comprises a support plate 106, spring arms 107, and a base 108. Preferably, spring 105 will have four spring arms 107, but spring 105 can have a range of spring arms 107, from as few as two to as many as one hundred. Spring 105 functions similar to that of a Belleville type spring that is known to the industry. When compressed, this spring 105 annularly spreads, meaning the spring arms 107 deform downward and outward, and the support plate 106 deforms outward. The support plate 106 has connection bands 109 that are between the areas where the support plate 106 and the spring arms 107 connect. These connection bands 109 act to limit the deformation of the spring arms 107 by controlling the annular spread of support plate 106. The annular spread can be further controlled by attaching a restraining cross clip to the connection bands 109. This restraining cross clip limits how far apart the connection bands 109 can pull away from each other, and thus makes the mattress firmer. Spring 105, via support plate 106, is preferably flush with a cover layer (as detailed in FIGS. 3 and 5 below). Spring 105 is attached to grid support 120 by connector 130. Connector 130 is preferably an insert and twist closure that interacts with grid support 120 and a second spring on the opposite side of grid support 120 (as detailed in FIG. 2 below). However, connector 130 can be any means for mounting the springs 100 back to back on the grid support 120 including, but not limited to, glue, insertion friction, snap, hook, latch, hook and eye, chemical bonding, bolt, bolt and twist, bayonet, pin, screw, rivet, clamp, or nail.

As shown in FIG. 1, grid support 120 preferably has a means of laterally connecting to other grid supports. FIG. 1 shows that this lateral connection means is preferably an insertion tab snap connector comprised of male connectors 121 and female connectors 122. The male connector of the grid support is inserted into and firmly attached to the female connector of an adjacently patterned grid support. FIG. 4 below shows the grid supports connected in a lateral grid. Although the insertion tab snap connector is the preferred lateral connection means, the grid supports 120 can be laterally interconnected in a variety of ways including, but not limited to, glue, insertion friction, snap, hook, latch, hook and eye, chemical bonding, bolt, bolt and twist, bayonet, pin, screw, rivet, clamp, or nail.

Figure 2:
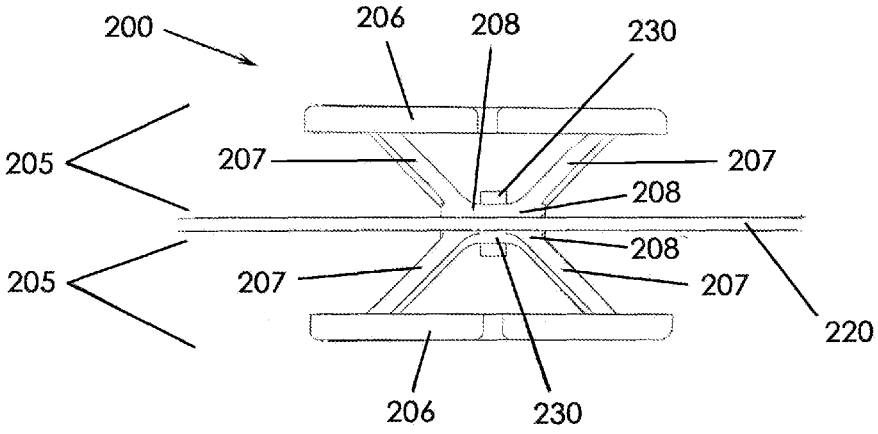
FIG. 2 is a detailed illustration of a side view of one embodiment of a spring element.

FIG. 2 is a detailed illustration of a side view of one embodiment of a spring element. FIG. 2 shows spring element 200 comprised of two springs 205 and grid support 220. As FIG. 2 details, spring arms 207 preferably extend diagonally outward from the base 208 to the support plate 206 at roughly a 45 degree angle. However, any angle between 1 and 89 degrees is acceptable. FIG. 2 also details that two springs 205 are preferably attached by connector 230 directly opposite each other in mirror image fashion on opposite sides of the grid support 220. Connector 230 is preferably a insert and twist closure that interacts with grid support 220 and the two opposing springs 205, but connector 230 can attach the springs 205 and the grid support 220 through a variety of means including, but not limited to, glue, insertion friction, snap, hook, latch, hook and eye, chemical bonding, bolt, bolt and twist, bayonet, pin, screw, rivet, clamp, or nail. Both springs 205, via support plates 206, are preferably flush with a cover layer (as detailed in FIGS. 3 and 5 below).

Figure 3:
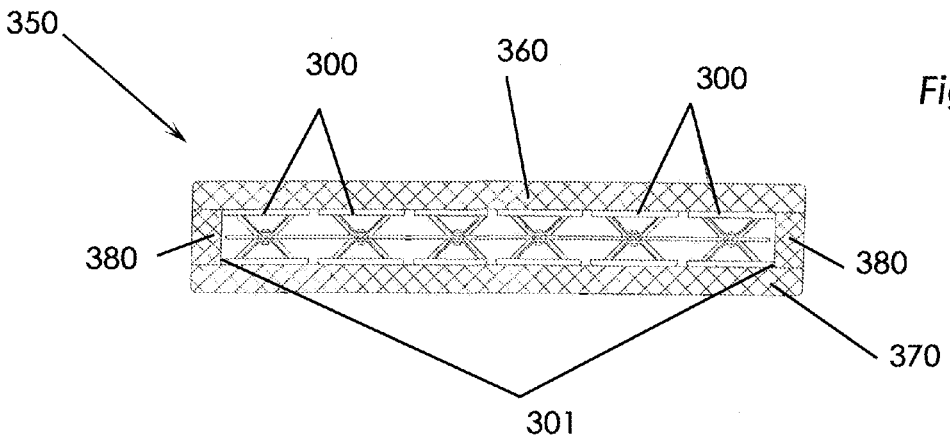
FIG. 3 is an illustration of a cutaway side view of one section of one embodiment of the mattress.

FIG. 3 is an illustration of a cutaway side view of one section of one embodiment of the mattress. Mattress 350 in FIG. 3 is shown with a top cover layer 360, a bottom cover layer 370, a frame layer 380, and a cavity 390 between top cover layer 360 and bottom cover layer 370. As shown in FIG. 3, a plurality of spring elements 300 have connected grid supports 320 forming a contiguously connected spring array 301. The contiguously connected spring array 301 is inserted into cavity 390 and is preferably in direct contact with top cover layer 360 and bottom cover layer 370. Even when the contiguously connected spring array 301 is inserted into cavity 390, cavity 390 is still relatively hollow and allows for beneficial ventilation. When a person lies on mattress 350, pressure is applied to one of the two cover layers, and the pressure is transmitted to the support plates 306 of the contiguously connected spring array 301. The contiguously connected spring array 301 responds to the pressure and supports in an ergonomic fashion the body of the person lying down. The support plates 306 broaden and act as a support surface for the top layer 360 or bottom layer 370 that are in direct contact with the support plates 306. When the mattress user gets off of the mattress, the pressure is removed and the springs return to their resting state. The springs do not fatigue because they are plastic. The top layer 360 and the bottom layer 370, as shown in FIG. 3, are preferably each made of a single layer of foam, but they can be made of any natural or synthetic soft padded or quilted material such cotton, nylon, horse hair, feathers, down, wool, or any combination of these materials. Additionally, top layer 360 and the bottom layer 370 can be made out of any number of layers of foam or padding, from two to two million, and whose thickness can be from 0.01 centimeters to 100 centimeters.

Figure 4A:
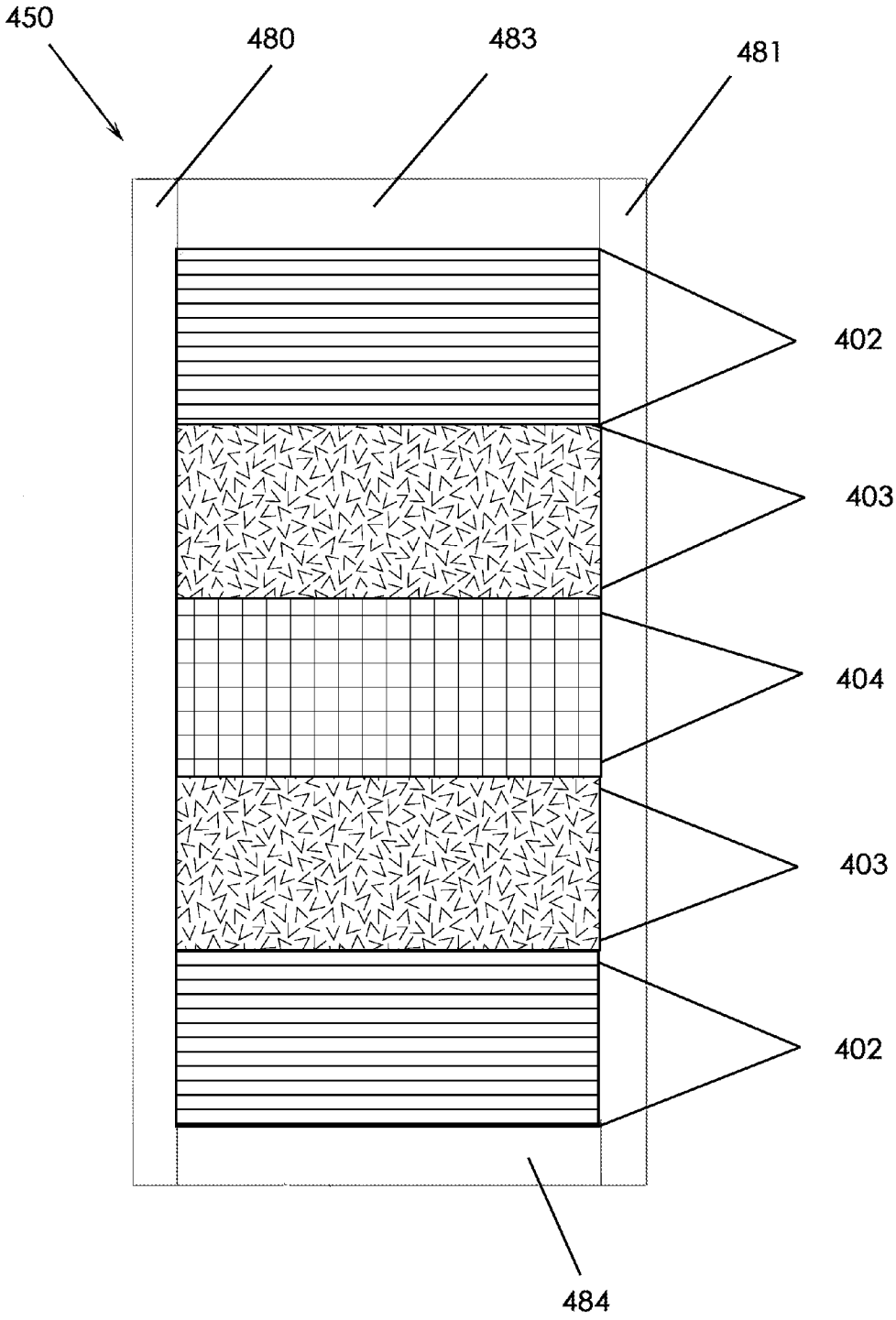
FIG. 4*a* is an illustration of a top view of several sections of one embodiment of the mattress to show the varying spring flexibility.

FIG. 4*a* is an illustration of a top view of several sections of one embodiment of the mattress to show the varying spring flexibility. Mattress 450 is preferably a standard size mattress, such as a twin, double, queen, king, or California king, but it can customized to form any size so as to fit an infant cradle, crib, an antique bed, a recreational vehicle, a boat or yacht, lawn or pool lounging chair, or an entire floor of a room of a home. Mattress 450 can be made with a weather resistant mattress cover that would allow mattress 450 to be suitable for outdoor use. FIG. 4*a* shows how frame layer 480, 481, 483, and 484 preferably enclose the spring array into the core of mattress 450. The frame layer 480, 481, 483, and 484 is preferably made from foam and is the same height as the back to back spring array, but it can be made out of padded plastic or other soft yet rigid materials or combination of materials that can act to stabilize the edges of mattress 450. Frame layer 480, 481, 483, and 484 preferably encloses all four sides of the spring array. However, the frame layer can also enclose only two or three sides without deviating from the present invention.

As shown in FIG. 4*a*, mattress 450 preferably has a pattern of varying spring flexibility that is laid out in a symmetrical mirror image. This allows either end of the mattress 450 to act as the head end. FIG. 4*a* shows that mattress 450 has a head end at frame layer 483, and a foot end at frame layer 484. The user's head would rest on frame layer 483 and his or her shoulders would rest on the springs in area 402, which are softer (more flexible) than springs in area 403, which would be beneath the user's back. The springs in area 404 are firmer springs and would support the user's torso. The rest of the mattress 450, which would support the legs, is a mirror image of the head end of the mattress. This way the user can lie with his or her head at either end of the mattress and get the same ergonomic support for his or her back, shoulders, and torso. As shown in FIG. 4*a*, the various spring areas are textured differently to show how the springs in those areas are grouped by varying flexibility. The spring arrays can be made stiffer in a variety of ways including, but not limited to, using a less flexible plastic, increasing the density or rigidity of the plastic, by adding restraining cross clips, or by manufacturing a spring with thicker portions.

Figure 4B:
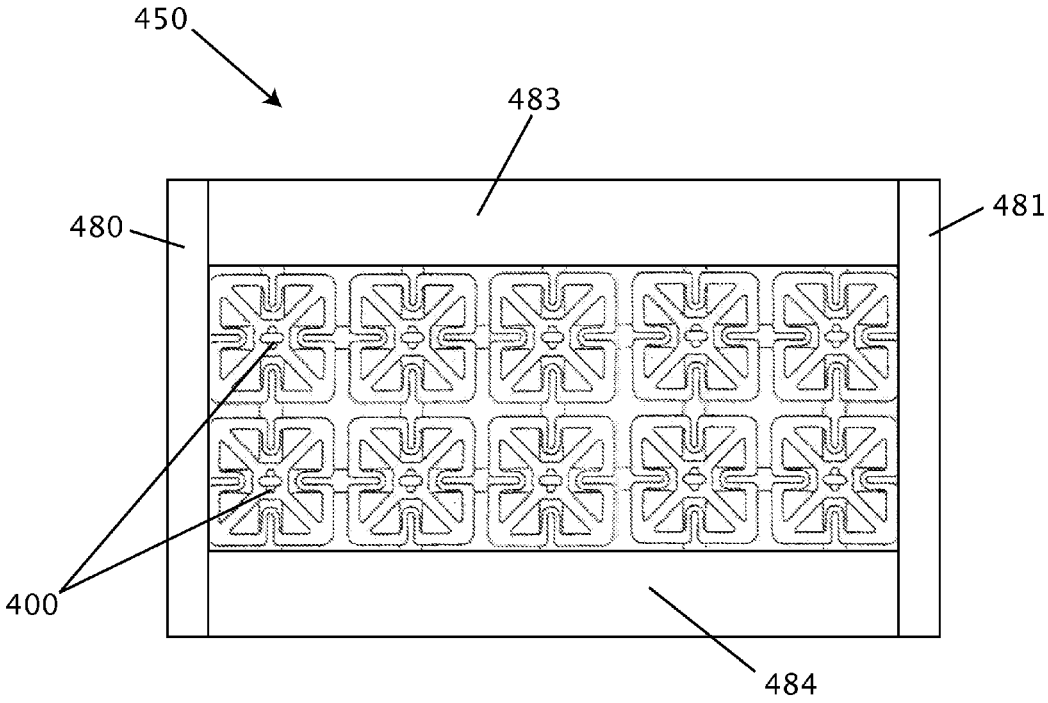
FIG. 4*b* is an illustration of a cutaway top view of one section of one embodiment of the mattress.

FIG. 4*b* is an illustration of a cutaway top view of one section of one embodiment of the mattress. FIG. 4*b* shows how spring arrays 400 are preferably connected laterally into a two dimensional grid pattern to form the core of mattress 450. FIG. 4*b* shows how frame layer 480, 481, 483, and 484 preferably enclose the spring array into the core of mattress 450.

Figure 5:
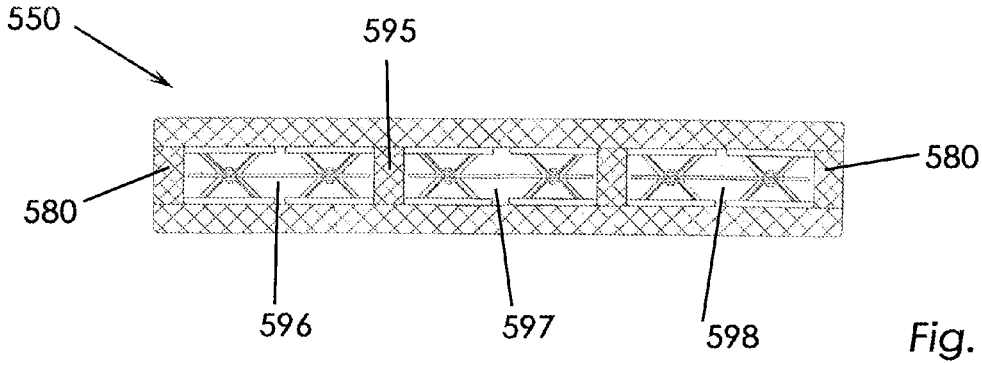
FIG. 5 is an illustration of a cutaway side view of one section of one embodiment of the mattress and details the flanges.

FIG. 5 is an illustration of a cutaway side view of one section of one embodiment of the mattress and details the flanges. Mattress 550, as shown in FIG. 5, preferably has flanges 595 that divide mattress 550 into separate recumbence areas 596, 597, and 598. The mattress 550 can be divided latitudinally, longitudinally, or both. The flanges 595 are preferably identical in characteristic and make to frame layer 580, but the flanges may be more rigid (or thicker) or more flexible (or thinner) than frame layer 580 depending on how much support is desired at that location in mattress 550. The separate recumbence areas 596, 597, and 598, preferably provide independent support and flex characteristics because they are divided by the supportive flanges 595, and because the spring arrays inserted into separate recumbence areas 596, 597, and 598 may have springs that differ in their spring flexibility. Thus, the recumbence area under the shoulders may be less rigid and the recumbence area under the torso may be more firm, for example. Each of these recumbence areas can be further sub-divided so that specific portions of the recumbence area is stiffer or more giving then the other subdivisions of that recumbence area. Of course, FIG. 5 shows just one embodiment of the invention, and there can be more than three recumbence areas, or fewer than three recumbence areas as described.

Figure 6:
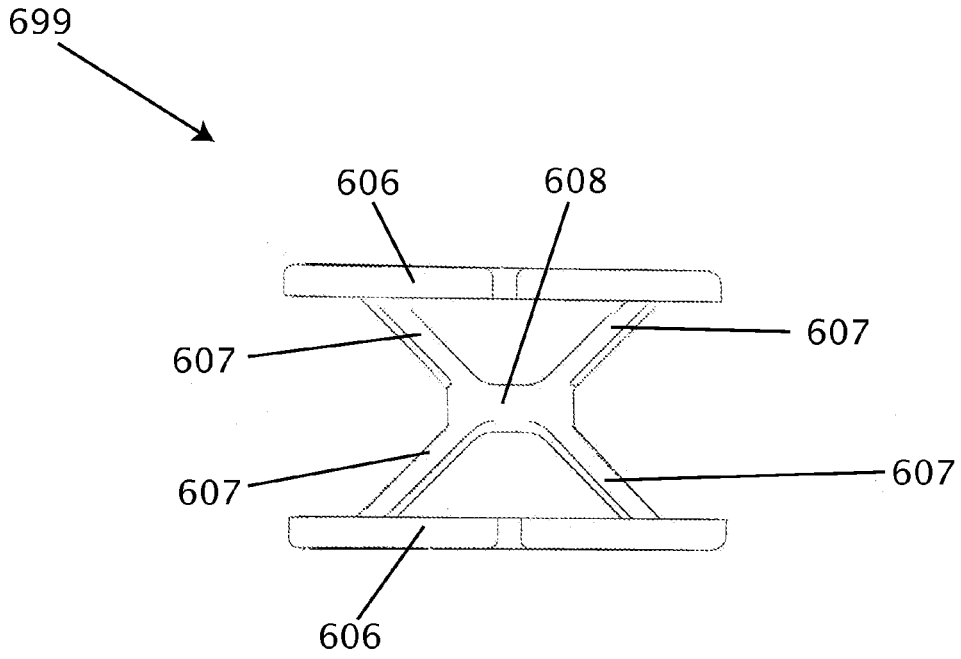
FIG. 6 is a detailed illustration of a side view of a single spring that is double ended.

FIG. 6 is a detailed illustration of a side view of a single spring that is double ended. FIG. 2*b* shows that in one embodiment of the invention, the spring element can be a single spring 699 that is double ended. As shown in FIG. 2, single spring 699 preferably has the same features and function of the back to back dual spring element described above and shown in FIGS. 1 and 2. Single spring 699 has at least two support plates 606. The support plates 606 are preferably on opposite distal ends of single spring 699. Single spring 699 further comprises a plurality of spring arms 607 that connect the support plates 606 to a mid-base 608. Preferably single spring 699 will have eight spring arms 607. However, single spring 699 can have as few as two and as many as two hundred spring arms without deviating from the scope of the present invention. Preferably single spring 699 is made using an injection mold process, however, any manufacturing method may be used if that method creates a contiguous single spring that is double ended. Additionally, single spring 699 can exhibit varying spring flexibility in the same manner as the back to back dual springs described above.

The mid-base 608 of single spring 699 preferably connects to a grid support using an insert and snap connector. However, single spring 699 can connect to a grid support using a variety of means including: insert and twist, glue, insertion friction, hook, latch, hook and eye, chemical bonding, bolt, bolt and twist, bayonet, pin, screw, rivet, clamp, or nail. Once connected to a grid support, single spring 699 and the grid support form a spring element that looks and functions essentially the same as the back to back dual spring element described.

In summary, the present invention is a mattress with two cover layers that enclose a spring array core wherein the springs are mounted back to back on a single interconnected grid support. The spring array is surrounded by a frame layer and is divisible into separate recumbence areas by supportive flanges.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A mattress, comprising:

a top cover layer;

a bottom cover layer;

a cavity between said top cover layer and said bottom cover layer;

a spring array comprising a plurality of grid supports and a plurality of springs;

a frame layer that encloses a plurality of sides of said spring array; and a removable mattress cover;

wherein said top cover layer includes a foam layer;

wherein said plurality of springs comprise a plurality of support plates, a plurality of spring arms, and a mid-base;

wherein a lower end of said plurality of spring arms is connected to said mid-base in a straight and in an angular position with respect to said mid-base;

wherein an upper end of said plurality of spring arms is connected to said support plate;

wherein said base attaches to one of said plurality of grid supports such that said support plate is distal to said plurality of grid supports;

wherein said plurality of springs annularly spread when pressure is applied to said plurality of springs such that said spring arms deform downward and outward, and the support plate deforms outward;

wherein said plurality of springs are attached to said plurality of grid supports at the mid-base of the plurality of springs;

wherein said plurality of grid supports are connected to each other;

wherein said connected grid supports are inserted into said cavity between said top cover layer and bottom cover layer;

wherein said plurality of springs are made of plastic;

wherein said plurality of springs show varying spring flexibility depending on where they are located on said connected grid supports;

wherein said mattress is divided into a plurality of recumbence areas, and said plurality of recumbence areas exhibit differing spring flexibility;

wherein said plurality of recumbence areas are separated by flanges so that said plurality of recumbence areas provide independent support and flex characteristics; and wherein said plurality of recumbence areas are divided into a plurality of subdivisions, and said plurality of subdivisions exhibit varying spring flexibility.

2. A mattress, comprising:

a top cover layer;

a bottom cover layer;

a cavity between said top cover layer and said bottom cover layer; and a spring array comprising a plurality of grid supports and a plurality of springs;

wherein said top cover layer includes a foam layer;

wherein said plurality of springs comprise a support plate, a plurality of spring arms, and a base;

wherein said base attaches to one of said plurality of grid supports such that said support plate is distal to said plurality of grid supports;

wherein said plurality of springs annularly spread when pressure is applied to said plurality of springs such that said spring arms deform downward and outward, and the support plate deforms outward;

wherein said plurality of springs are attached on opposite sides of said plurality of grid supports such that said opposite mounted springs are mirror images of each other;

wherein said plurality of grid supports are connected to each other; and wherein said connected grid supports are inserted into said cavity between said top cover layer and bottom cover layer.

3. The mattress of claim 2, wherein said plurality of springs are made of plastic.

4. The mattress of claim 3, wherein said plurality of springs show varying spring flexibility depending on where they are located on said connected grid supports.

5. The mattress of claim 4, further comprising:

a frame layer that encloses a plurality of sides of said spring array; and a removable mattress cover.

6. The mattress of claim 5, wherein said mattress is divided into a plurality of recumbence areas, and said plurality of recumbence areas exhibit varying spring flexibility.

7. The mattress of claim 6, wherein said plurality of recumbence areas are separated by flanges so that said plurality of recumbence areas provide independent support and flex characteristics.

8. The mattress of claim 7, wherein said plurality of recumbence areas are divided into a plurality of subdivisions, and said plurality of subdivisions exhibit varying spring flexibility.

9. A mattress, comprising:

a top cover layer;

a bottom cover layer;

a cavity between said top cover layer and said bottom cover layer; and a spring array comprising a plurality of grid supports and a plurality of springs;

wherein said top cover layer includes a foam layer;

wherein said plurality of springs comprise a support plate, a plurality of spring arms, and a base;

wherein said base attaches to one of said plurality of grid supports such that said support plate is distal to said plurality of grid supports;

wherein said plurality of springs annularly spread when pressure is applied to said plurality of springs such that said spring arms deform downward and outward, and the support plate deforms outward;

wherein said plurality of springs are attached on opposite sides of said plurality of grid supports;

wherein said plurality of grid supports are connected to each other;

wherein said connected grid supports are inserted into said cavity between said top cover layer and bottom cover layer; and wherein said plurality of springs are made of plastic.

10. The mattress of claim 9, wherein said plurality of springs show varying spring flexibility depending on where they are located on said connected grid supports.

11. The mattress of claim 10, further comprising:

a frame layer that encloses a plurality of sides of said spring array; and a removable mattress cover.

12. The mattress of claim 11, wherein said mattress is divided into a plurality of recumbence areas, and said plurality of recumbence areas exhibit differing spring flexibility.

13. The mattress of claim 12, wherein said plurality of recumbence areas area separated by flanges so that said plurality of recumbence areas provide independent support and flex characteristics.

14. The mattress of claim 13, wherein said plurality of recumbence areas are divided into a plurality of subdivisions, and said plurality of subdivisions exhibit varying spring flexibility.

15. A mattress comprising:

a top cover layer;

a bottom cover layer;

a cavity between said top cover layer and said bottom cover layer;

a spring array comprising a plurality of grid supports and a plurality of springs;

a frame layer that encloses a plurality of sides of said spring array; and a removable mattress cover;

wherein said top cover layer includes a foam layer;

wherein said plurality of springs comprise a support plate, a plurality of spring arms, and a base;

wherein said base attaches to one of said plurality of grid supports such that said support plate is distal to said plurality of grid supports;

wherein said plurality of springs annularly spread when pressure is applied to said plurality of springs such that said spring arms deform downward and outward, and the support plate deforms outward;

wherein said plurality of springs are attached on opposite sides of said plurality of grid supports;

wherein said plurality of springs are plastic and show varying spring flexibility depending on where they are located on said connected grid supports;

wherein said plurality of grid supports are connected to each other;

wherein said connected grid supports are inserted into said cavity between said top cover layer and bottom cover layer;

wherein said mattress is divided into a plurality of recumbence areas and said plurality of recumbence areas are separated by flanges so that said plurality of recumbence areas provide independent support and flex characteristics;

wherein said plurality of recumbence areas exhibit varying spring flexibility;

wherein said plurality of recumbence areas are divided into a plurality of subdivisions; and wherein said plurality of subdivisions exhibit differing spring flexibility.

16. A mattress comprising:

a top cover layer;

a bottom cover layer;

a cavity between said top cover layer and said bottom cover layer; and a spring array comprising a plurality of grid supports and a plurality of springs;

wherein said top cover layer includes a foam layer;

wherein said plurality of springs comprise a plurality of support plates, a plurality of spring arms, and a mid-base;

wherein a lower end of said plurality of spring arms is connected to said mid-base in a straight and angular position with respect to said mid-base;

wherein an upper end of said plurality of spring arms is connected to said support plate;

wherein said base attaches to one of said plurality of grid supports such that said support plate is distal to said plurality of grid supports;

wherein said plurality of springs annularly spread when pressure is applied to said plurality of springs such that said spring arms deform downward and outward, and the support plate deforms outward;

wherein said plurality of springs are attached to said plurality of grid supports at the mid-base of the plurality of springs;

wherein said plurality of grid supports are connected to each other;

wherein said connected grid supports are inserted into said cavity between said top cover layer and bottom cover layer; and wherein said plurality of springs are made of plastic.

17. The mattress of claim 16, wherein said plurality of springs show varying spring flexibility depending on where they are located on said connected grid supports.

18. The mattress of claim 17, further comprising:

a frame layer that encloses a plurality of sides of said spring array; and a removable mattress cover.

19. The mattress of claim 18, wherein said mattress is divided into a plurality of recumbence areas, and said plurality of recumbence areas exhibit differing spring flexibility.

20. The mattress of claim 19, wherein said plurality of recumbence areas are separated by flanges so that said plurality of recumbence areas provide independent support and flex characteristics.

21. The mattress of claim 20, wherein said plurality of recumbence areas are divided into a plurality of subdivisions, and said plurality of subdivisions exhibit varying spring flexibility.

* * * * *